US005213620A

United States Patent [19]

Meyer

[11] Patent Number: 5,213,620

[45] Date of Patent: May 25, 1993

[54] PAINT SPRAYING MACHINE

[76] Inventor: Erich Meyer, Hauptstrasse 19, CH-4557 Horriwil, Switzerland

[21] Appl. No.: 762,757

[22] Filed: Sep. 19, 1991

[30] Foreign Application Priority Data

Sep. 20, 1990 [CH] Switzerland ..... 03038/90

[51] Int. Cl.[5] ..... B05B 15/00

[52] U.S. Cl. ..... 118/323; 118/324

[58] Field of Search ..... 118/323, 324, 309

[56] References Cited

U.S. PATENT DOCUMENTS 4,762,013 8/1988 Peter et al. ..... 118/315
4,951,600 8/1990 Soshi et al. ..... 118/323
5,092,307 3/1992 Behr et al. ..... 118/315

FOREIGN PATENT DOCUMENTS 0338334 10/1989 European Pat. Off. .
2080345 11/1971 France .
2087269 5/1982 United Kingdom .
2190312 11/1987 United Kingdom .

*Primary Examiner*—W. Gary Jones
*Assistant Examiner*—Charles K. Friedman
*Attorney, Agent, or Firm*—Cushman, Darby & Cushman

[57] ABSTRACT

The invention relates to a paint spraying machine for the painting of motor-vehicle bodies in particular. The machine is equipped with at least one movement device which is connected dynamically to one or more paint spraying appliances. The paint spraying appliances move in two spatial axes lying transversely relative to the conveying direction of the bodies and pivot about one of these axes. The movement device is assigned further linear-movement and pivoting devices which impart to the paint spraying appliances a movement in a third spatial axis lying along the conveying direction.

5 Claims, 4 Drawing Sheets

PAINT SPRAYING MACHINE

The invention relates to a paint spraying machine for the painting of motor-vehicle bodies, with at least one movement device having one or more paint spraying appliances which are connected dynamically to it and which are moved linearly by the movement device in two spatial axes lying transversely relative to the conveying direction of the bodies and are pivoted about at least one spatial axis.

Paint spraying machines for the painting of automobile bodies are known, having paint spraying appliances which are moved along the body surface transversely relative to the conveying direction by devices arranged laterally or above the body.

A known feature of paint spraying automobile bodies is that the distance of the paint spraying appliance or the paint spraying distance should always be the same over the entire surface and the spraying direction, always be perpendicular to the surface.

A contour machine is known from European Patent Application (Publication No. 0,338,334 A), wherein paint spraying appliances are driven linearly along two spatial axes and rotate about two spatial axes via a plurality of motors. Since this arrangement can execute only relatively slow movements, in particular in the X- and Z-axis, it is unsuitable for the front and rear parts of vehicles. In known continuous-flow installations, the individual bodies succeed one another at short intervals. Paint spraying appliances which are moved only in the X- and Z-axis, such as, for example, with the above-described known contour machine, are too slow to move into and out of the interspaces between the bodies during the remaining time, without collisions with the bodies.

Nor does a further known paint spraying machine solve this problem, although this allows a very rapid traveling movement of the paint spraying appliances in the X- and Z-axes. This known arrangement uses a straddle gantry which is displaceable in the vertical direction (Z-axis) in lateral stands. The straddle gantry is pivotable about the X-axis and carries a displacement unit which is displaceable in the X-axis. The displacement unit is equipped with paint spraying appliances which are themselves pivotable about the Y-axis. Even with this device, front and rear parts cannot be painted satisfactorily.

The object of the invention is to evenly paint vertically long front and rear parts of bodies in a continuous-flow process.

The above object is achieved, according to the innovation, in that the movement device is assigned means which allow the paint spraying appliances to move in a third spatial axis which lies along the conveying direction of the body to be painted.

The advantage of the invention is that, as a result of the movement of the paint spraying appliances in the third axis (Y-axis), the paint-spraying appliances can run with the bodies in the conveying direction within a particular working range, even when the movement device is stationary in relation to the conveyance.

According to a preferred embodiment, it is therefore advantageous if the means assigned to the movement device consist of at least one linear-movement device and of at least one pivoting device which are combined in their movements for the purpose of moving at least one paint spraying appliance in a spatial axis lying along the conveying direction. Since the automobile bodies possess virtually only curved surfaces, it is necessary to impart multi-dimensional movements to the paint spraying appliances. A further embodiment affords a solution for achieving this object wherein the linear-movement device consists of at least one lifting device and at least one pivoting shaft mounted rotatably therein. The pivoting device consists of at least one pivoting arm connected to the pivoting shaft and a transverse gantry arranged at a distance from the pivoting shaft. A transverse gantry carries a cross-displacement device. Furthermore, if the transverse gantry is mounted pivotably in the pivoting arm, and the cross-displacement device carries a pivoting mechanism, on which at least one paint spraying appliance is articulated.

The combination of five movements provides the paint spraying appliances with a corresponding maximum three-dimensional zone of action.

The modular and flexible construction and the stationarily arranged drives make it possible to use the paint spraying machine according to the invention inside or outside a spray booth.

Exemplary embodiments of the paint spraying machine according to the invention are explained in more detail below with reference to the accompanying figure.

Figure 1:
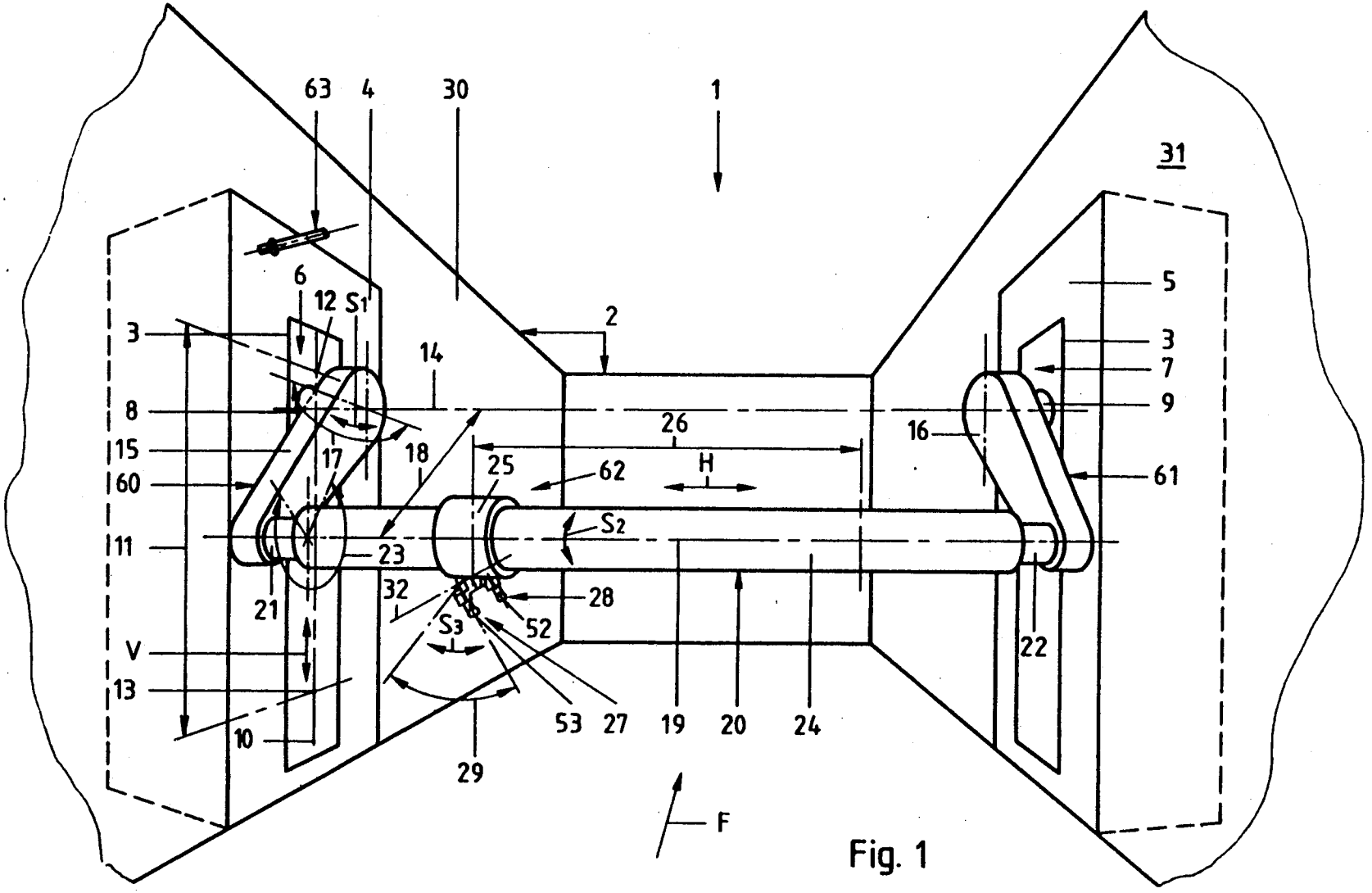
FIG. 1 shows a perspective representation of a first embodiment with paint spraying appliances displaceable and pivotable transversely relative to the direction of travel.
Figure 2:
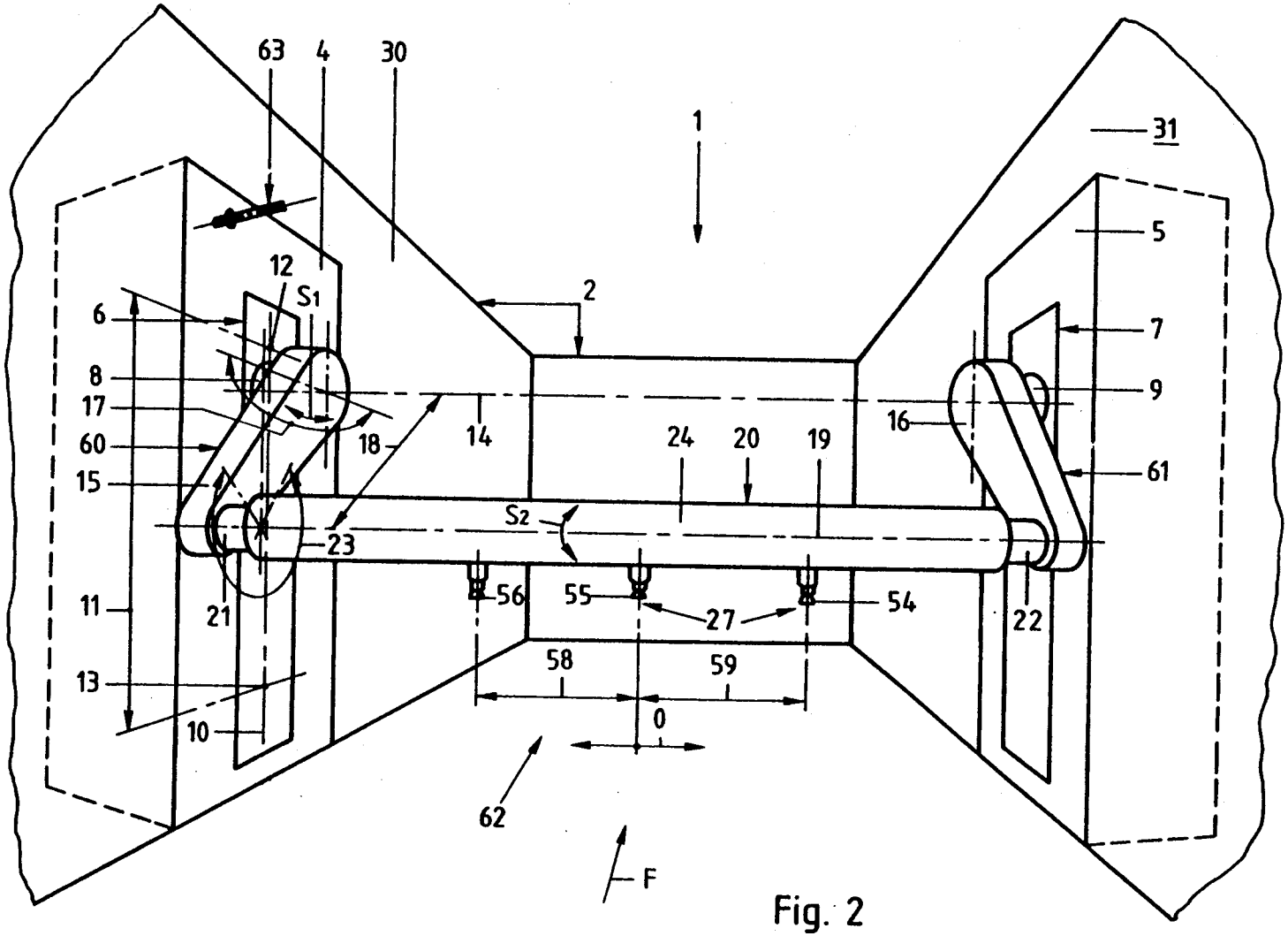
FIG. 2 shows a perspective representation of a second embodiment with paint spraying appliances oscillating transversely relative to the direction of travel.

The embodiments represented in FIGS. 1 and 2 possess fundamentally the same arrangement according to the invention. The differences are in the choice and movement cycle of the paint spraying appliances. The elements of the basic arrangement and their description therefore apply to both embodiments in FIGS. 1 and 2.

The basic arrangement has a paint spraying machine 1 which is arranged, for example, in a spray booth 2 of an automobile-body painting installation. Automobile bodies are moved in a way not shown in the conveying direction F between a left side wall 30 and a right side wall 31 of the spray booth 2, in order to be covered with a coat of paint. A left side module 4 is arranged in the left side wall 30 and a right side module 5 in the right side wall 31. The side modules 4 and 5 are movement devices which are equipped with driving members (not shown) for the paint spraying machine 1 and its movement members. Each movement device is assigned means which impart movements of differing axes to one or more paint spraying appliances. These means consist of pivoting and linear-movement devices. Thus, for instance, the left side module 4 is assigned a left lifting device 6 and the right side module 5 a right lifting device 7. Each lifting device 6,7 is equipped with a pivoting device 60,61. The left lifting device 6 carries a left pivoting shaft 8 and the right lifting device 7 a right pivoting shaft 9. The pivoting shafts 8 and 9 lie in a common horizontal axes 14. The two lifting devices 6 and 7 move the pivoting shafts 8 and 9 in the direction of a vertical axes designated by 10. A clearance 3 in the side modules 4 and 5 allows the pivoting shafts 8 and 9 to execute a vertical movement V. The vertical movement V takes place between an upper reversal point 12 and a lower reversal point 13. Between the points 12 and 13 the horizontal axes 14 executes a vertical effective stroke 11. The vertical axes 10 is stationary in relation to the spray booth 1 or the conveying direction F.

The two pivoting shafts 8 and 9 are so coupled to one another that they are jointly movable about the horizontal axes 14 in the direction of a pivoting movement S1. The pivoting movement S1 takes place over the range of a pivot angle 17. The drive for the pivoting movement S1 is located in a way not shown in the side modules 4 and 5.

The left pivoting shaft 8 is connected firmly to a left pivoting arm 15 and the right pivoting shaft 9 to a right pivoting arm 16. The pivoting arms 15 and 16 therefore execute the same pivoting movement S1 as the pivoting shafts 8 and 9.

The left side arm 15 carries a left axle 21 and the right pivoting arm 16 an axle 22. Each of the axles 21 and 22 is located at a distance 18 from the axes 14 on the respective pivoting arm. The two axles 21 and 22 therefore lie on a common pivot axes 19. The pivot axles 21 and 22 are connected to one another via a transverse gantry 20. The transverse gantry 20 consists of a transverse-gantry shaft 24 which thus likewise lies on the pivot axes 19.

The axles 21 and 22 are mounted pivotably in the respective pivoting arms and are set in pivoting movement S2 about the pivot axes 19 by driving means not shown in more detail. Force-transmission means (not shown) are provided in the pivoting arms 15 and 16 and within the pivoting shafts 8 and 9. The drive itself takes place in the respective side modules 4 and 5. The pivoting movement S2 takes place within a pivot angle 23. As a result of the rotation of the pivoting shafts 8 and 9, the transverse gantry 20 or the transverse-gantry shaft 24 executes the pivoting movement S1 at the distance 18 (which equals pivot radius) about the horizontal axes 14. The pivoting movement S2 about its own pivot axes 19 is simultaneously possible.

Drive connection 63 is diagrammatically shown in FIG. 1 which, can couple the drives of the side modules 4 and 5 to one another.

Figure 3:
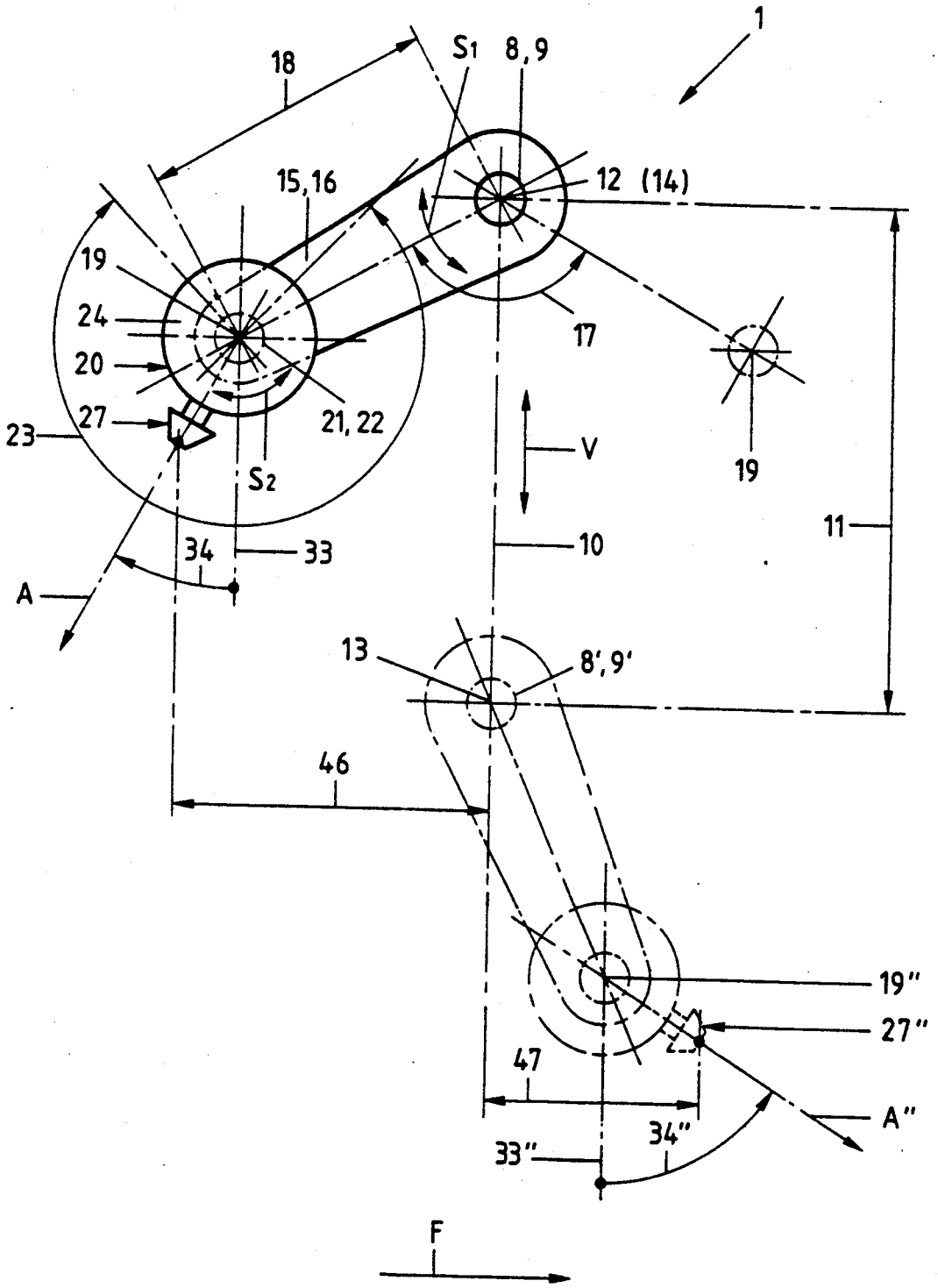
FIG. 3 shows a diagrammatic representation of the arrangement according to the invention of a paint spraying machine.

FIG. 3 illustrates diagrammatically the movement possibilities V, S1 and S2 and how the basic arrangement of the paint spraying machine according to the invention allows such movement. For example, if the transverse-gantry shaft 24 is equipped with a paint spraying appliance 27 which flings paint particles against a body in the spraying direction A, the paint spraying appliance 27 can, on the one hand, be moved in or against the conveying direction F as a result of the combination of the movements V, S1 and S2. On the other hand, the spraying direction A can be at different angles 34 relative to a perpendicular 33 to the conveying direction F or parallel to the vertical axes 10. In the example illustrated, the spraying direction A is opposite to the conveying direction F, that is to say the angle 34 is negative. In the position represented by dot-and-dash lines at the lower reversal point 13, for example the paint spraying appliance 27″ is so arranged that the spraying direction A″ points in the conveying direction F, that is to say the angle 34″ is positive.

The paint spraying appliance 27 is at a trailing distance 46 from the vertical axes 10. In the position represented by dot-and-dash lines, the paint spraying appliance 27″ is at a leading distance 47 from the vertical axes 10.

Figure 4:
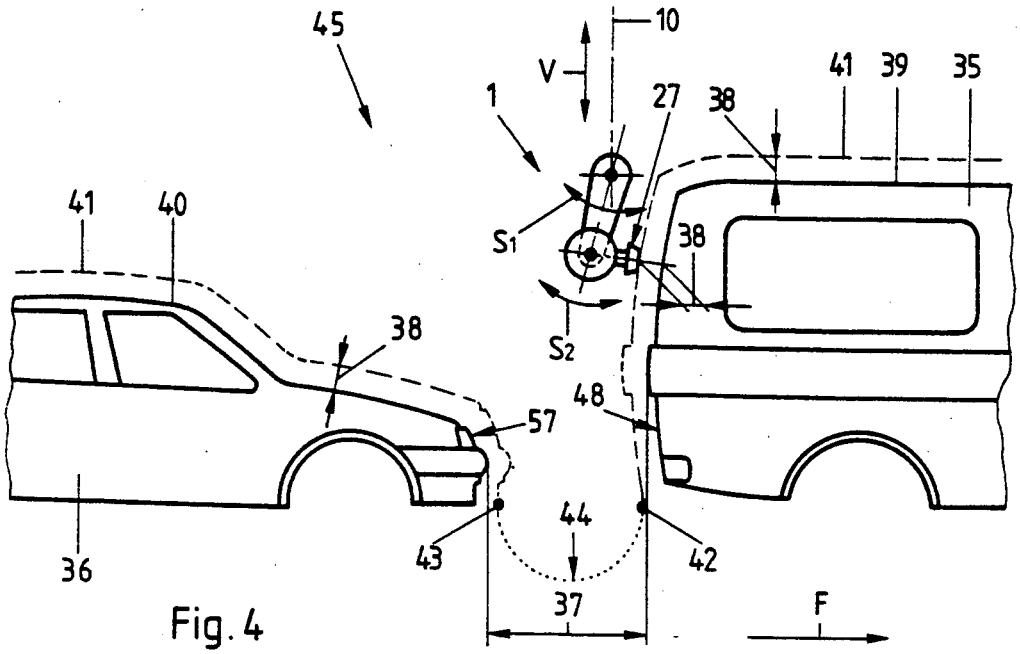
FIG. 4 shows a diagrammatic representation of a paint spraying machine according to the invention in an automobile-body spraying installation.

FIG. 4 illustrates an automobile-body spraying installation 45 with a leading body 35 having a body surface 39 and a trailing body 36 having a body surface 40. The bodies 35 and 36 succeed one another at a distance 37 in the conveying direction F. Spraying distance 38 denotes a distance at which a paint spraying appliance 27 is positioned in relation to the automobile-body surface.

Drawn along the body surfaces 39 and 40 is a dot-and-dash line 41 which thus defines the position of one or more paint spraying appliances 27 during the spraying operation. Since the paint spraying must always take place perpendicularly to the body surface 39 and 40, the angle 34 shown in FIG. 3, must always be matched to the respective surface point.

The paint spraying machine 1 is shown merely diagrammatically in FIG. 4.

Marked on the dot-and-dash line 41 is a point 42. This marks the position of the paint spraying appliance 27 in relation to the last surface point of a rear part 48 on the body surface 39 of the leading body 35 which has to be sprayed. A point 43 marks the position of the paint spraying appliance 27 in relation to the first surface point of a front part 59 on the body surface 40 of the trailing body 36 which has to be sprayed. A dotted line 44 between the points 42 and 43 represents the movement cycle of the paint spraying appliance 27. The paint spraying direction A at the point 42 is virtually or approximately the same as the conveying direction F. In contrast, at the point 43, the paint spraying direction is opposite to the conveying direction F. The paint spraying appliance 27 changes the spraying direction virtually through 180°. Since, under practical operating conditions, the bodies succeed one another at relatively short distances 37 and the throughflow speeds are likewise relatively high, it is necessary to ensure that the paint spraying machine 1 or the paint spraying appliance 27 can execute not only a vertical movement V and a pivoting movement S2, but also additionally a pivoting movement S1.

This makes it possible, according to the invention, to obtain the leading and trailing distance of the paint spraying appliance 27 in relation to the stationary vertical axes 10 in the spray booth 1.

In FIG. 1, furthermore, arranged on the transverse-gantry shaft 24 is a cross-displacement device 62 with a displacement ring 25. The latter can execute on the transverse-gantry shaft 24 a horizontal transverse movement H with a horizontal stroke 26. The horizontal stroke 26 corresponds to the effective stroke of the machine.

Figure 5:
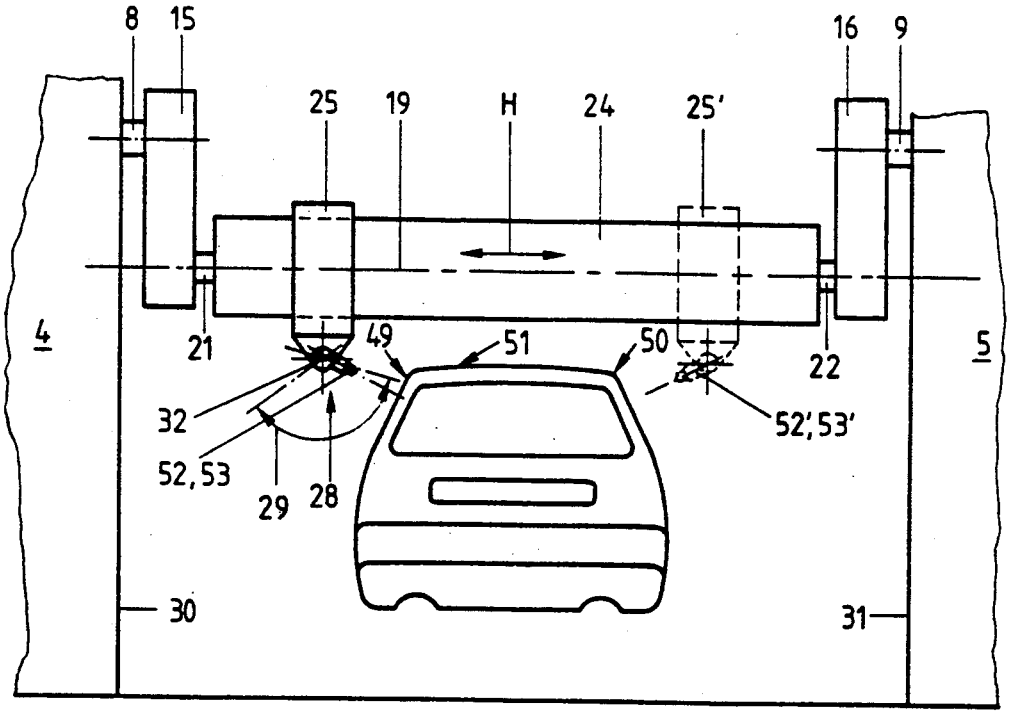
FIG. 5 shows a cross-section through a spray booth of an embodiment represented in FIG. 1.

The displacement ring 25 is equipped with a pivoting mechanism 28. This moves about a pivot axes 32. The pivot axes 32 extends, for example, parallel to the conveying direction F. In the present example, the pivoting mechanism 28 carries two spray guns 52,53 which execute a pivoting movement S3 about the pivot axes 32. The pivoting movement S3 takes place within a pivot angle 29. Thus, corner parts 49 and 50 (FIG. 5) of an automobile-body roof 51 can be provided, as required, with a paint coating.

In FIG. 2, furthermore, a plurality of paint spraying appliances 27 transversely connected to one another are provided, in the example shown the appliances 27 are electrostatic spray bells 54,55,56. The spray bells 54,55,56 move parallel to one another in an oscillating movement O. The spray bells 54,55,56 are arranged at adjustable distances 58,59 from one another. The amplitude of the oscillating movement O is such that the paint spray mists of the respective adjacent spray bells supplement one another and provide on the body surface a coat of paint balanced in terms of thickness and surface equality.

The spray bells 54,55 and 56 likewise execute the pivoting movement S2 about the pivot axes 19.

In the illustrated embodiments of the paint spraying machine according to the invention, one or more paint spraying appliances can be attached to the transverse gantry.

The paint spraying machine is preferably of modular construction, for example side modules and connecting modules (transverse gantry) arranged transversely. Intercoupling is obtained between the side module and transverse gantry by means of pivoting arms.

The movements (number of axes) necessary for a particular use and the movement lengths (effective strokes and pivot angles) are selected specifically in view of the given requirements.

The drives provided for the axial movement are arranged stationarily, so that the danger of cable breaks can be avoided.

The particular flexibility of the paint spraying machine 1 allows it to be used inside or outside a spray booth 2. In the outside-the-booth version, as shown in FIGS. 1 and 2, the side modules 4,5 are arranged outside the booth. The pivoting arms 15,16 and the transverse module 20 are located inside the booth 2. A clearance 3 in the booth side walls in the direction of the linear movement V of the side modules allows the connection between the side and transverse module by means of the pivoting arms.

In the inside-the-booth version, the entire paint spraying machine is set up inside the booth.

The paint spraying machine according to the invention is especially suitable for the painting of motor-vehicle bodies.

I claim:

1. A paint spraying machine for painting motor vehicle bodies, said bodies being conveyed in a particular direction, said spraying machine comprising:

two stationary side modules arranged in a transversely spaced apart relation, the vehicle bodies being conveyed between said side modules, each said side module including a lifting device being movable along a first spatial axis, each said lifting device carrying a pivoting arm being pivotable about a common pivot axis extending transversely to the conveying direction of the bodies;

a transverse gantry shaft carrying at least one spraying appliance, said gantry shaft having two ends and being pivotably supported at both said ends in one of said pivoting arms about an axis extending in a spaced apart relation to the common pivot axis, said axis constituting a second spatial axis;

means for jointly moving said lifting devices; and means for pivoting said transverse gantry shaft, said moving means jointly pivoting said pivoting arms, whereby, when said gantry shaft is moved in combination with said lifting devices, said at least one appliance is moved in a third spatial axis and said at least one appliance is capable of being directed toward the bodies by pivoting movement of said gantry shaft about said second spatial axis.

2. A paint spraying machine according to claim 1, wherein said moving means and said pivoting means remain stationary in relation to said conveyance of said bodies.

3. A paint spraying machine according to claim 1, wherein said moving means remains stationary in relation to said conveyance of said bodies.

4. An arrangement including a paint spraying machine as claimed in claim 3 and further comprising a spray booth, said spraying machine being disposed inside said spray booth.

5. An arrangement including a paint spraying machine as claimed in claim 3 and further comprising a spray booth, said side modules being disposed outside said spray booth and said pivoting arms and said transverse gantry shaft being disposed inside said spray booth.

* * * * *